US012674251B2

(12) United States Patent
Fare'

(10) Patent No.: US 12,674,251 B2
(45) Date of Patent: Jul. 7, 2026

(54) SPINNING HEAD AND RELATIVE APPARATUS FOR THE PRODUCTION OF FILAMENTS

(71) Applicant: FARE' S.P.A. a socio unico, Fagnano Olona (IT)

(72) Inventor: Rosaldo Fare', Fagnano Olona (IT)

(73) Assignee: FARE' S.P.A. a socio unico, Fagnano Olona (IT)

( * ) Notice: Subject to any disclaimer, the term of this patent is extended or adjusted under 35 U.S.C. 154(b) by 61 days.

(21) Appl. No.: 18/755,934

(22) Filed: Jun. 27, 2024

(65) Prior Publication Data

US 2025/0003114 A1 Jan. 2, 2025

(30) Foreign Application Priority Data

Jun. 28, 2023 (EP) ..... 23182176

(51) Int. Cl.
*D01D 4/02* (2006.01)
*D01D 5/08* (2006.01)

(52) U.S. Cl.
CPC ..... *D01D 4/02* (2013.01); *D01D 5/08* (2013.01)

(58) Field of Classification Search
CPC ..... D01D 4/02; D01D 5/08; D01D 5/0985; D01D 4/06
See application file for complete search history.

(56) References Cited

U.S. PATENT DOCUMENTS

| | | | | |
|---|---|---|---|---|
| 11,447,893 | B2 | 9/2022 | Cook et al. | |
| 2019/0153622 | A1* | 5/2019 | Cook | D01D 4/025 |
| 2022/0002913 | A1* | 1/2022 | Matsuura | D02J 1/225 |
| 2022/0307175 | A1* | 9/2022 | Conrad | D01F 6/06 |
| 2023/0364843 | A1* | 11/2023 | Michihira | B29C 48/05 |

FOREIGN PATENT DOCUMENTS

| | | | |
|---|---|---|---|
| CN | 102286791 | A | 12/2011 |
| EP | 0377926 | B1 | 3/1994 |
| JP | 2003155620 | A | 5/2003 |

OTHER PUBLICATIONS

Priority Search Report issued by the EPO on Jun. 5, 2024 for EP priority application No. EP23182176.0.

* cited by examiner

*Primary Examiner* — Michael M. Robinson

(57) ABSTRACT

A spinning head has a feed channel for feeding material to be extruded, a distribution chamber, and an extrusion surface having extrusion holes. The distribution chamber has a lower surface and an upper surface opposite the lower surface. The distance between the upper surface and the lower surface of the distribution chamber is reduced. The distance reduction may be a substantially continuous reduction or a discontinuous reduction. In the discontinuous reduction example, the upper surface includes portions that are substantially parallel to the lower surface and portions inclined with respect to the lower surface. The substantially parallel and inclined portions are in an alternating arrangement.

16 Claims, 4 Drawing Sheets

SPINNING HEAD AND RELATIVE APPARATUS FOR THE PRODUCTION OF FILAMENTS

TECHNICAL FIELD

The present invention relates to a spinning head for producing filaments, in particular spinning heads having large dimensions, that is to say having a width (i.e. a dimension measured along a direction perpendicular to the direction of filament extrusion) greater than 400 mm.

BACKGROUND

It is known to produce filaments by extruding material, typically polymer, through spinnerets equipped with a spinning head having a plurality of extrusion holes, which are typically arranged in multiple series.

In the spinneret head there are one or more distribution chambers to feed material to the extrusion holes. Specifically, distribution channels extend from the distribution chamber and feed material to the extrusion holes. The extrusion holes can be arranged at the end of the distribution channels (i.e., there is one hole per channel), or a distribution channel can feed multiple extrusion holes. A single distribution chamber can be provided for all holes, or the holes can be divided into a number of groups, each group having a corresponding distribution chamber. Typically, there is a single feed channel for each distribution chamber which feeds material to holes of different series of holes.

Typically, the filaments extruded from the holes that are farthest away from the feed channel have mechanical properties that are unsatisfactory or, in any case, inferior to those of the filaments extruded from holes that are closer to the feed channel.

SUMMARY

The Applicant found that this difference in properties is affected by the different residence time of the material inside the distribution chamber, depending on the extrusion hole from which the material is extruded, so that the temperature (and therefore the fluidity/viscosity) of the material can vary significantly between holes of different series.

In particular, a distribution chamber 4 of the known art generally has substantially rectangular section, as in FIG. 1.

The path, and therefore the residence time, of the molten material inside the distribution chamber is significantly longer at the holes fed by the distribution channel 3", that is to say the holes farthest away from the feed channel 5, than the residence time inside the distribution chamber 4 of the material extruded from the holes fed by the distribution channel 3", that is to say the holes closest to feed channel 5.

Object of the present invention is therefore to equalize (or at least improve the uniformity of) the properties of the filaments extruded from different series of extrusion holes which are fed from the same distribution chamber.

These and other objects are solved by a spinning head and a related apparatus according to the appended claims.

In particular, the subject matter of the present invention is a spinning head and related apparatus according to the independent claims, while preferred aspects are set forth in the dependent claims.

According to an aspect, a spinning head for a plant for making synthetic filaments comprises a body provided with an extrusion surface having a plurality of extrusion holes, a distribution chamber made in the body, at least one feed channel for feeding material to the distribution chamber, distribution channels for feeding material from the distribution chamber to the extrusion holes. The distribution chamber comprises a lower surface which faces the extrusion surface and is parallel thereto, and an upper surface opposite the lower surface, in which on at least one section plane perpendicular to the extrusion surface, the distance between the upper surface and the lower surface of the distribution chamber is reduced in a moving-away direction from the feed channel, so that moving away from a feed channel the area of the distribution chamber is progressively reduced. The distance is reduced in a manner selected from: a) a substantially continuous reduction; b) a discontinuous reduction in which, in the upper surface, a plurality of first portions substantially parallel to the lower surface alternate with a plurality of second portions inclined with respect to the lower surface.

Preferably, therefore, in the option a) the shape of the upper surface of the distribution chamber is a substantially conical or pyramidal shape, whereas in the option b) the shape of the upper surface is a stepped shape.

Because of this, it is possible to make a distribution chamber in which the temperature and viscosity of the material extruded from the extrusion holes is substantially uniform, or at least less variable compared to a chamber having constant height. Therefore, thanks to the present solution, it is possible to make a distribution chamber whose volume gradually decreases while moving away from the feed channel. The volume of material arranged above the distribution channels (and thus from the extrusion holes) which are farthest from the feed channel is less than the volume of material arranged above the distribution channels (and thus from the extrusion holes) which are closest to the feed channel. As a result, the residence time in the distribution chamber of the material intended to exit the holes farthest from the feed channel can be reduced compared to an embodiment of the known art similar to that shown in FIG. 1.

According to an aspect, the distance decreases according to option b), and at least one distribution channel is arranged at each of the second portions, preferably at an end of said second portions.

In preferred embodiments, there are holes arranged substantially concentrically on the extrusion surface.

According to an aspect, the extrusion surface has substantially circular shape and the section plane contains a radius of said extrusion surface.

In particular, the extrusion surface can form an entire circumference or an arc of a circumference.

According to an aspect, the spinning head comprises multiple feed channels, wherein the shape of the upper surface complies with the option a) or b) for at least one of the feed channels of the spinning head.

According to an aspect, the distance is discontinuously reduced and said plurality of second inclined portions forms an inner angle with said lower surface. According to an aspect, the inner angle is in the range of 5° to 60°, preferably 150 to 300.

The inner angle is not necessarily the same for all second inclined portions.

A subject matter of the present invention relates to an apparatus for producing filaments which comprises a spinning head according to one or more of the preceding claims. Typically, such an apparatus is a spunbond apparatus for producing nonwoven fabrics.

A subject matter of the present invention further relates to a process for extruding filaments by means of an apparatus according to claim 7, comprising the step of sending molten polymeric material to said distribution chamber of said spinning head, and the step of extruding a plurality of filaments from the extrusion holes.

Preferably, the temperature of the filaments extruded from the extrusion holes is basically homogeneous.

This temperature can be measured by optical detectors, for example.

According to an aspect, the difference in the residence time of the material inside the distribution chamber between material exiting different holes is less than 20 minutes, preferably less than 15 minutes.

This difference can be estimated, for example, by a color change of the extrusion material.

If a material of a first color is fed to the distribution chamber, all filaments extruded from the extrusion holes are of that first color.

By subsequently feeding a material of a second color, the filaments extruded from the extrusion holes change color from the first color to the second color. This transition is faster for holes closer to the feed channel, whereas it is slower for filaments extruded from extrusion holes farther from the feed channel. The difference in the elapsed time for the transition from the first to the second color of the filaments between the extrusion holes provides an estimate of the difference in the residence time of the extruded material inside the distribution chamber between those holes. This operation can be repeated several times (e.g. three times) to obtain an average value of time difference between the various repetitions. The extruded filaments for such tests are preferably made of polypropylene.

BRIEF DESCRIPTION OF THE DRAWING

Hereinafter, referring to the appended figures, exemplary and non-limiting embodiments of the present invention will be described, in which.

DETAILED DESCRIPTION

Figure 1:
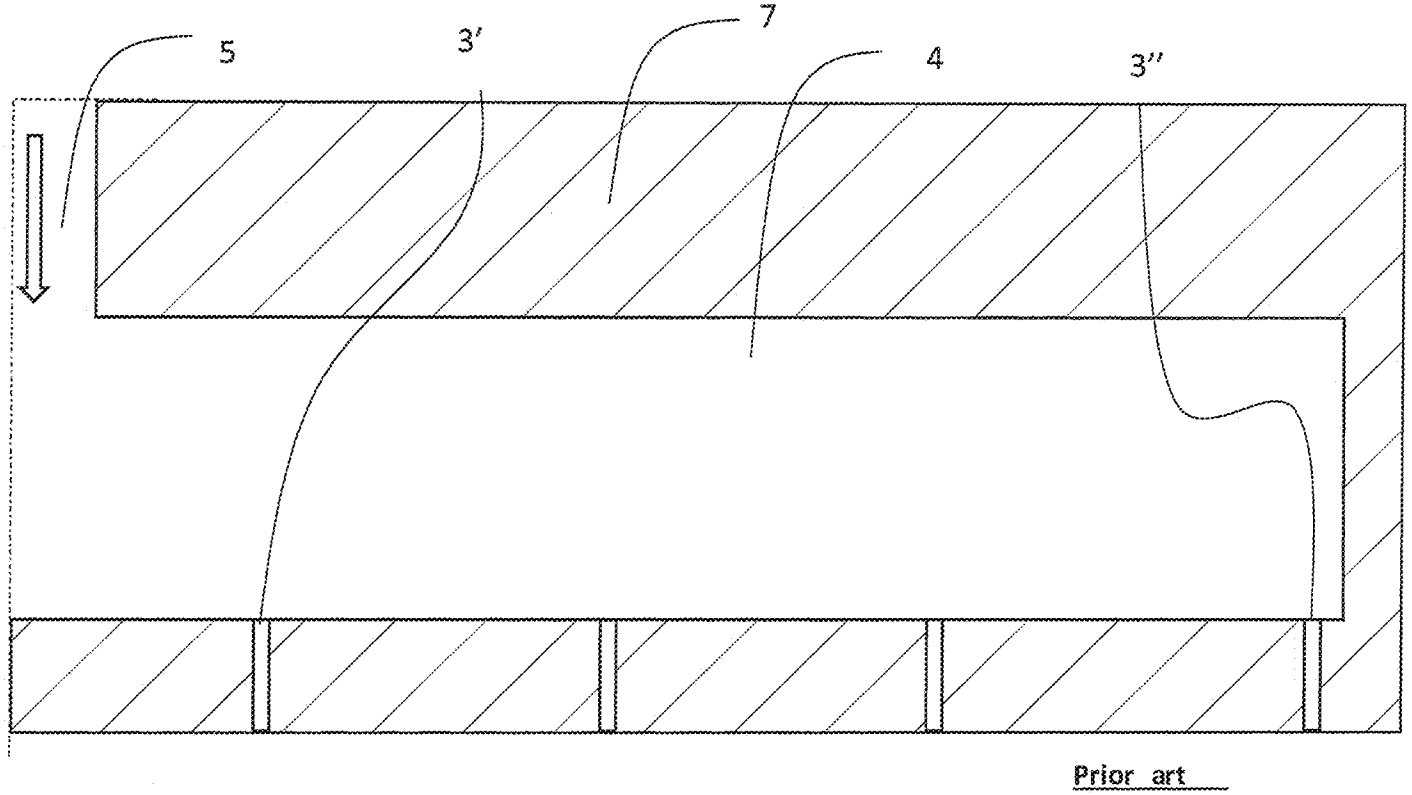
FIG. 1 is a schematic view of a spinneret head according to a known-art solution.

A spinning head 1 for a plant for making synthetic filaments 10 comprises a body 7 equipped with an extrusion surface 8 provided with a plurality of extrusion holes 30.

The holes 30 are typically arranged depending on the geometry of the spinning head and in particular the extrusion surface 8. Typically, the extrusion surface 8 has circular geometry. In such a case the holes are preferably arranged concentrically, along several circumferences (or arcs of circumferences) C'-C''''.

The body 7 of the spinning head 1 comprises a distribution chamber 4 for feeding material to the extrusion holes 30, and a feed channel 5 for feeding material to the distribution chamber 4.

Specifically, feed channels 3 extend from the distribution chamber 4 and are connected to the extrusion holes 30. As explained above, each distribution channel 3 may terminate in an extrusion hole 30 or a single distribution channel 3 may feed multiple extrusion holes 30 via fluidic elements (typically channels or chambers, not shown in detail in the figures) interposed between the distribution channels 3 and the extrusion holes 30.

It should be noted that, in FIGS. 2A and 2B, in order to make it easier to understand the geometry of the distribution chamber 4 and to identify the various elements thereof, the body 7 is shown only below the distribution chamber, while only a small portion is shown above the latter. However, similar to what is shown in FIG. 1, it is understood that the body 7 surrounds the distribution chamber 4.

Typically, once extruded from the spinning head 1, the material is a polymer material adapted to form synthetic filaments.

The distribution chamber 4 comprises a lower surface 2 facing toward, and parallel to, the extrusion surface 8, and an upper surface 6 opposite the lower surface 2. Hereinafter, "lower surface 2" and "upper surface 6" will refer to the lower and upper surface of the distribution chamber 4.

The distribution chamber 4 is such that there is at least one section plane P perpendicular to the extrusion surface 8 (typically a vertical plane in the condition of use of the spinning head) in which in the section of the distribution chamber 4, the distance H between the upper surface 6 and the lower surface 2 is reduced in a moving-away direction D from the feed channel 5.

Figure 3:
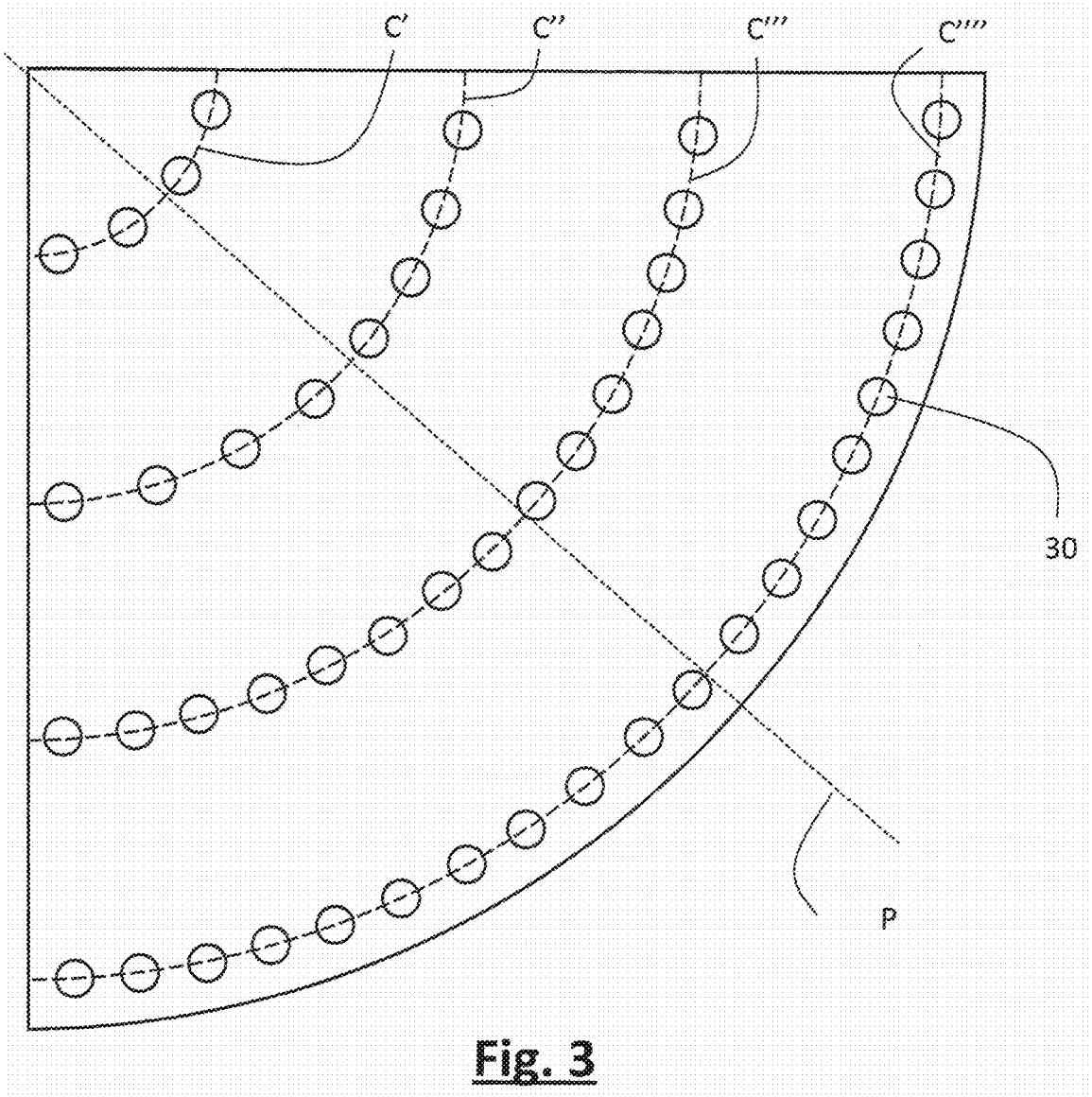
FIG. 3 is a bottom view of a portion of the extrusion surface of a spinneret head according to an embodiment of the present invention.

It should be noted that, as for example in FIG. 3, the section plane P may not intersect any extrusion holes 30.

The moving-away direction D from the feed channel 5 is considered on the section plane P and is parallel to the lower surface 2. Typically, such moving-away direction D is considered from a straight line RA perpendicular to the extrusion surface 8, which intersects the axis of the feed channel 5 at the outlet of the feed channel 5 within the distribution chamber 4. Typically, as in the appended figures, the axis of the feed channel 5 is perpendicular to the extrusion surface 8. In such a case, the straight line RA coincides with the axis of the feed channel 5.

It should be noted that on a plane there are only two moving-away directions from the RA line. The properties discussed herein apply to at least one of the two moving-away directions, preferably both.

The distance H is not evaluated at a feed channel 5 but only where the upper surface 6 is present.

The distance H is measured in the direction perpendicular to the lower surface 2.

As previously discussed, two options for reducing the height H are possible.

Figure 2A:
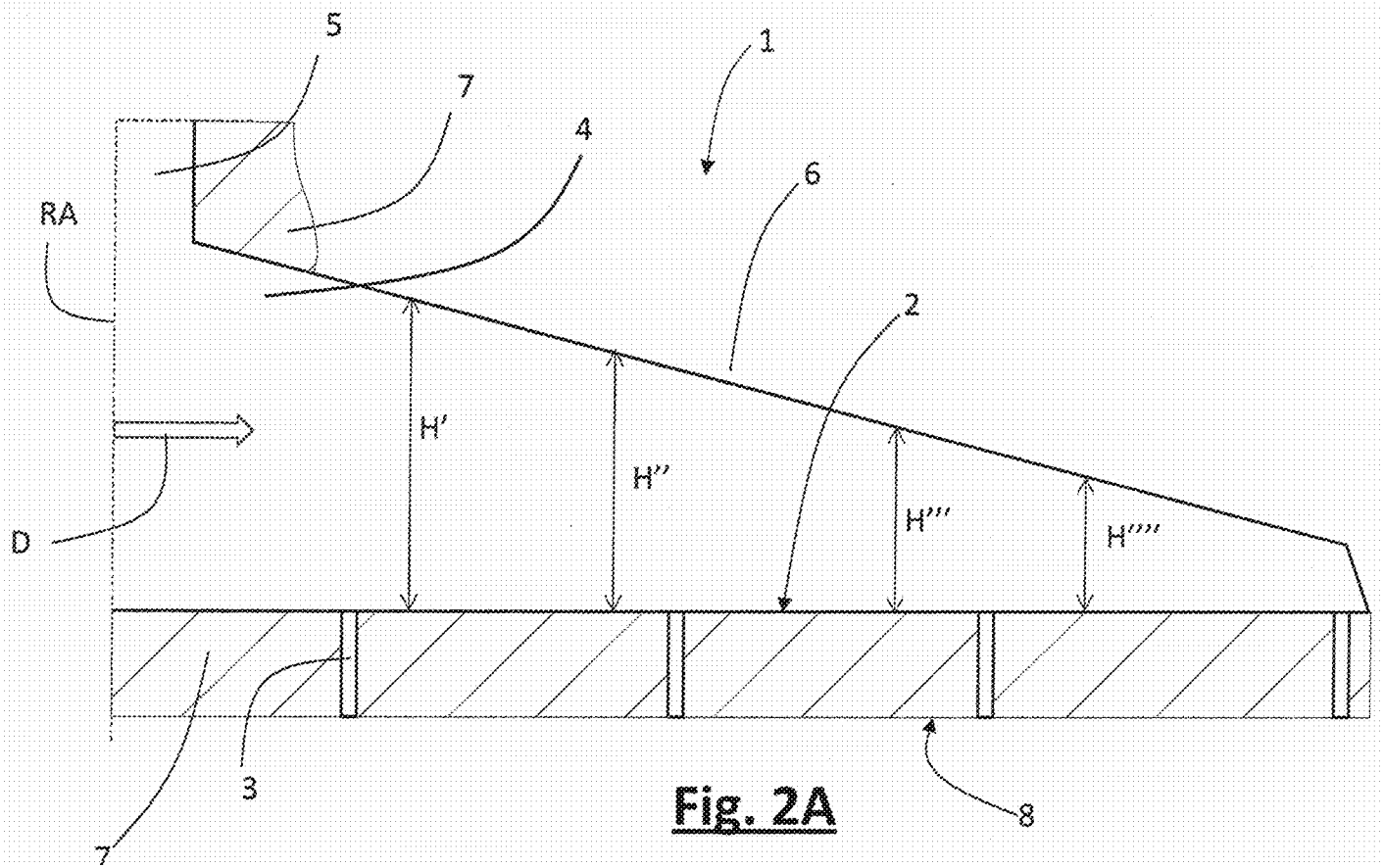
FIG. 2A is a schematic view of a half section of a spinneret head according to an embodiment of the present invention.

In embodiments according to a first option, such as the embodiment in FIG. 2A, a substantially continuous reduction of the distance H is provided.

In such embodiments, the distance H measured at two different points of the distribution chamber is always less at the point farthest from the feed channel.

Consider, for example, the four distances H'-H''' shown in FIG. 2A. Considering each possible pair of distances between the four distances H'-H''', the distance of the most downstream pair (with respect to the moving-away direction D) is always less than the distance of the pair arranged upstream, so that H'>H''>H'''>H''''.

The upper surface on the section plane is preferably substantially straight or straight for at least 80% of its length, with a change in slope at the end arranged at the lower surface 2, as in the embodiment of FIG. 2A.

However, embodiments in which the upper surface 6, on the section plane P, is a broken line composed of several line segments with different inclinations, or a curved line, are not excluded.

According to a second option, the reduction of the distance H is discontinuous. For example, a possible embodiment configured as the second option is shown in FIG. 2B.

In embodiments according to the second option, the upper surface 6 has a plurality of first portions 6*a* substantially parallel to the lower surface 2 which alternate with a plurality of second portions 6*b* inclined with respect to the extrusion surface 8.

It should be noted that there are at least two first portions 6*a* and at least two second portions 6*b*.

As discussed, the first portions are substantially parallel to the lower surface 2. At these portions, the distance H between the lower surface 2 and the upper surface 6 remains substantially unchanged in the moving-away direction D from the supply channel 5. With reference to FIG. 2B, the distances H' and H" are measured at the same first portion 6*a*, so that the distance H" is equal to the distance H', even though the distance H" is downstream of the distance H' regarding to the moving-away direction D.

The second portions are inclined (possibly even perpendicular) with respect to the lower surface 2. As a result, at a second portion 6*b*, the distance H between the upper surface 6 and the lower surface 2 is reduced. This reduction can be sudden (in the case of the second portion 6*b* perpendicular to the lower surface 2) or, more commonly, progressive while moving away from the feed channel 5, as in FIG. 2.

In embodiments according to the second option, in which the distance H is reduced discontinuously (option b), the second portions 6*b* can form an inner angle α with the lower surface 2 of the distribution chamber 4.

Figure 2B:
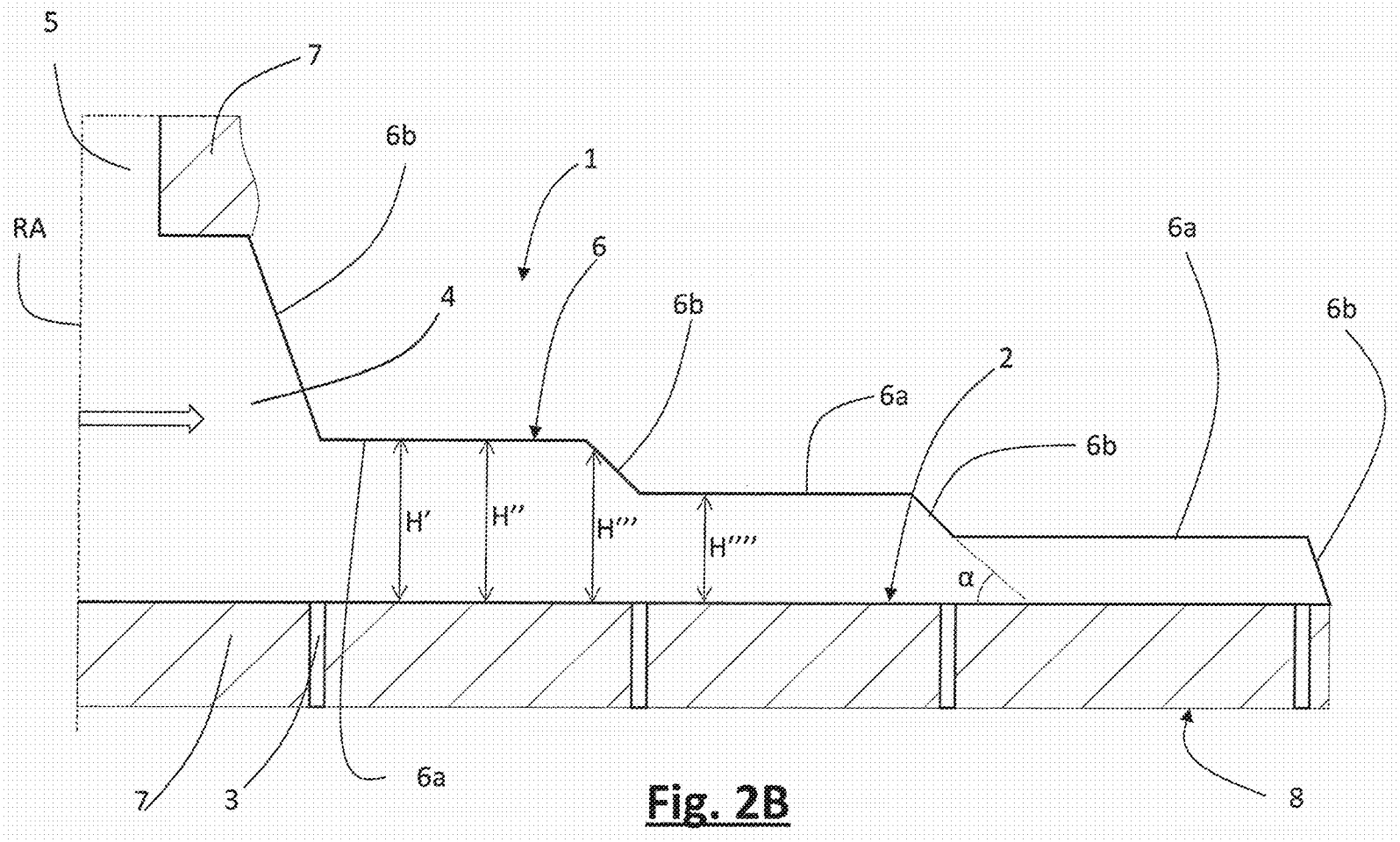
FIG. 2B is a schematic view of a half section of a spinneret head according to an embodiment alternative to the one of FIG. 2A.

As shown in FIG. 2B, the inner angle α is the (acute) angle facing the inside of the spinning head, i.e. facing the feed channel 5. The inner angle α is formed by the projection of the second portions 6*b* along a line which lies on them and which intersects the lower surface 2. The inner angle α is not necessarily the same for all second inclined portions 6*b*.

According to a possible aspect, the inner angle α is in the range between 5° and 60°, preferably between 15° and 30°.

It should be noted that, with the possible exception of the ends of the upper surface 6, between two first portions 6*a* there is a second portion 6*b*. In these two first portions, the distance H is smaller in the first portion 6*a* upstream of the second portion 6*b* under consideration.

For example, considering the values of distances H'-H''' shown in FIG. 2B, the distance H''' is measured at a second portion 6*b*. In the first upstream portion 6*a*, the distance value is H'=H". In the first downstream portion, the distance is H'''', where H''''<H'.

At the second portion, the distance decreases from the H' value to the H'''' value. Therefore, the distance value H'''' measured at the second portion 6B is less than H' and greater than H''''. As discussed, in alternative embodiments, this transition can be instantaneous by means of a second portion perpendicular to the lower surface 2.

Preferably, there is at least one section plane P in which there is a distribution channel 3 at a second portion 6*b* of the upper surface 6, typically at one end of each second portion 6*b*. In other words, for every second portion 6*b*, there is at least one plane P in which the second option previously discussed (stepped shape of the upper surface 6) is fulfilled, in which there is a distribution channel 3 at this second portion. For the sake of simplicity, FIG. 2B shows a section plan in which a distribution channel 3 is arranged at each of the second portions 6*b*. However, like the extrusion holes 30 shown in FIG. 3, the distribution channels 3 may be staggered from each other, so that there may not be a single plane intersecting the distribution channels 3 arranged at each second portion 6*b*. As a matter of fact, it is sufficient that, for each inclined portion 6*b*, there is a section plane perpendicular to the extrusion surface 8, having a shape as per the second option (stepped shape), in which a distribution channel 3 is arranged. It is possible that this condition is met by different second portions 6*b* in planes different from each other. Typically, in the case of circular geometry of the extrusion surface 8, these planes are rotated relative to each other with respect to the center of the extrusion surface 8, that is, they contain different diameters of the extrusion surface 8.

In possible solutions, the distribution channels 3 are arranged exclusively at the second portions 6*b* of the upper surface 6.

The figures show embodiments in which there is a single feed channel 5. However, embodiments having multiple feed channels are not excluded. In this case, the properties discussed above apply to at least one of the feed channels in the spinning head. For example, multiple feed channels could be arranged along a circumference on the extrusion surface. The extrusion plane is selected so that it crosses at least one of these channels (or two channels arranged opposite with respect to the center of the extrusion surface). In such a case, the properties discussed above apply to at least one moving-away direction from one of these feed channels 5.

In use, some molten polymer material is fed, in a known manner, to the feed channel 5 (or to the feed channels 5).

The distribution chamber 4 is then filled with the polymer material, which then passes through the distribution channels and, from these, reaches the extrusion holes, then exiting them so as to form flows of high-temperature material that, upon cooling, form polymer filaments. In particular, due to the special design of the spinning head, the difference in the residence time inside the distribution chamber of the material extruded from different holes is reduced, and the maximum difference is typically less than 20 minutes, preferably than 15 minutes. In other words, the time spent by some polymer material inside the distribution chamber 4, before being extruded from the extrusion holes farthest from the feed channel 5, does not differ excessively from the time spent by some polymer material inside the distribution chamber 4 before being extruded from the extrusion holes closest to the feed channel 5.

The extrusion temperature, i.e., the temperature of the polymer material at the extrusion holes, is substantially homogeneous for all holes, with variability preferably within 10° C., more preferably within 5° C., even more preferably within 2° C. In other words, by evaluating the temperature of the polymer material extruded from each extrusion hole, a minimum value of the temperature at a first extrusion hole and a maximum value of the extrusion temperature at a second hole can be defined. The difference between this minimum value and this maximum value (which can be assessed by optical systems, for example) is preferably less than 10° C., more preferably within 5° C., even more preferably within 2° C.

The invention claimed is:

1. A spinning head (1) for a plant for making synthetic filaments, comprising:

a body (7) provided with an extrusion surface (8) having a plurality of extrusion holes (30), a distribution chamber (4) n said body, a feed channel (5) for feeding material to said distribution chamber, distribution channels (3) for feeding material from said distribution chamber to said extrusion holes (30), said distribution chamber (4) comprising a lower surface (2) which faces said extrusion surface (8) and is parallel to said extrusion surface (8), and an upper surface (6) opposite said lower surface (2), wherein said distribution chamber (4) includes a distance (H) between the upper surface (6) and the lower surface (2) of the distribution chamber, said distance (H) extending along a direction parallel to said distribution channels (3) and perpendicular to said extrusion surface (8), wherein said distance (H) is reduced along a direction extending away from the feed channel (5), so that the area of the distribution chamber is progressively reduced along the direction extending away from the feed channel (5), and wherein said distance (H) is reduced in a manner selected from:

a) a substantially continuous reduction, b) a discontinuous reduction in which, in the upper surface (6), a plurality of first portions (6*a*) substantially parallel to the lower surface (2) alternate with a plurality of second portions (6*b*) inclined with respect to the lower surface (2).

2. The spinning head according to claim 1, wherein the distance (H) decreases according to said discontinuous reduction, and wherein at least one said distribution channel (3) is disposed at each of said second portions.

3. The spinning head according to claim 1 wherein said plurality of extrusion holes (30) are arranged in a substantially concentric pattern on said extrusion surface (8).

4. The spinning head according to claim 1, wherein said extrusion surface has a substantially circular shape and said section plane has a length equal to a diameter of said extrusion surface.

5. The spinning head according to claim 1, further comprising a plurality of said feed channels and wherein said distance (H) is reduced in a manner selected from said a) and said b), for at least one of said plurality of feed channels.

6. The spinning head according to claim 1, wherein said distance (H) is discontinuously reduced and said plurality of inclined second portions (6*b*) form an inner angle ($\alpha$) in the range of 5° to 60°, with said lower surface (2).

7. The spinning head according to claim 6, wherein said inner angle ($\alpha$) is in the range of 15° to 30°.

8. The spinning head according to claim 2, wherein the distance (H) decreases according to said discontinuous reduction, and wherein at least one said distribution channel (3) is disposed at an end of each of said second portions.

9. The spinning head according to claim 2, wherein said plurality of extrusion holes (30) are arranged substantially concentrically on said extrusion surface (8).

10. The spinning head according to claim 3, wherein said distance (H) is discontinuously reduced and said plurality of inclined second portions (6*b*) form an inner angle ($\alpha$) in the range of 5° to 60°, with said lower surface (2).

11. The spinning head according to claim 2, wherein said plurality of extrusion holes (30) are arranged in a substantially concentric pattern on said extrusion surface (8).

12. An apparatus for producing filaments, comprising a spinning head according to claim 1.

13. A process for extruding filaments by means of an apparatus according to claim 12, comprising the steps of feeding molten polymeric material to said distribution chamber of said spinning head and extruding a plurality of filaments from said extrusion holes.

14. The process according to claim 13, wherein the temperature of the filaments extruded from said extrusion holes is substantially homogeneous.

15. The process according to claim 13, wherein the difference in residence time of the material inside the distribution chamber exiting through different holes is less than 20 minutes.

16. The process according to claim 14, wherein the difference in residence time of the material inside the distribution chamber exiting through different holes is less than 15 minutes.

* * * * *